US006837379B2

(12) United States Patent
Dennis et al.

(10) Patent No.: US 6,837,379 B2
(45) Date of Patent: Jan. 4, 2005

(54) DISPLAY BOX

(75) Inventors: Angela Dennis, Oshawa (CA); Peter Widdis, Toronto (CA)

(73) Assignee: Cadbury Trebor Allan Inc., Toronto (CA)

( * ) Notice: Subject to any disclaimer, the term of this patent is extended or adjusted under 35 U.S.C. 154(b) by 226 days.

(21) Appl. No.: 10/073,887

(22) Filed: Feb. 14, 2002

(65) Prior Publication Data

US 2003/0150773 A1 Aug. 14, 2003

(51) Int. Cl.[7] ..... B65D 25/00
(52) U.S. Cl. ..... 206/767; 206/45.29
(58) Field of Search ..... 206/45.28, 45.29, 206/767, 768, 459.5; 229/102.5; 40/312

(56) References Cited

U.S. PATENT DOCUMENTS 1,926,299 A * 9/1933 Monk ..... 206/45.29
2,136,797 A * 11/1938 Lee ..... 206/767
2,168,240 A * 8/1939 Paul ..... 206/45.29
2,730,232 A * 1/1956 Coe ..... 206/45.29
2,914,236 A * 11/1959 Shapiro ..... 206/767
2,973,086 A * 2/1961 Joseph ..... 206/767
4,201,291 A * 5/1980 Davidson ..... 206/768
4,756,409 A * 7/1988 Murray ..... 206/459.5
4,860,886 A * 8/1989 Northrup et al. ..... 206/45.29
6,213,298 B1 * 4/2001 Nguyen ..... 206/767

* cited by examiner

*Primary Examiner*—Luan K. Bui

(57) ABSTRACT

A combination shipping/display box for displaying goods for sale is disclosed. The box includes a front panel, a bottom panel and a number of other panels. The front, bottom and other panels define a compartment for holding the goods. The bottom panel and the front panel include a display tab integrally formed therein. The display tab has a perforated first edge and a second edge along which the display tab is attached to the box. The display tab may be detached from the box along the perforated first edge but remain attached to the box along the second edge. The display tab includes a display portion and a swing portion attached to the box along the second edge. The display portion may be moved relative to the swing portion along a fold defined in the display tab.

19 Claims, 4 Drawing Sheets

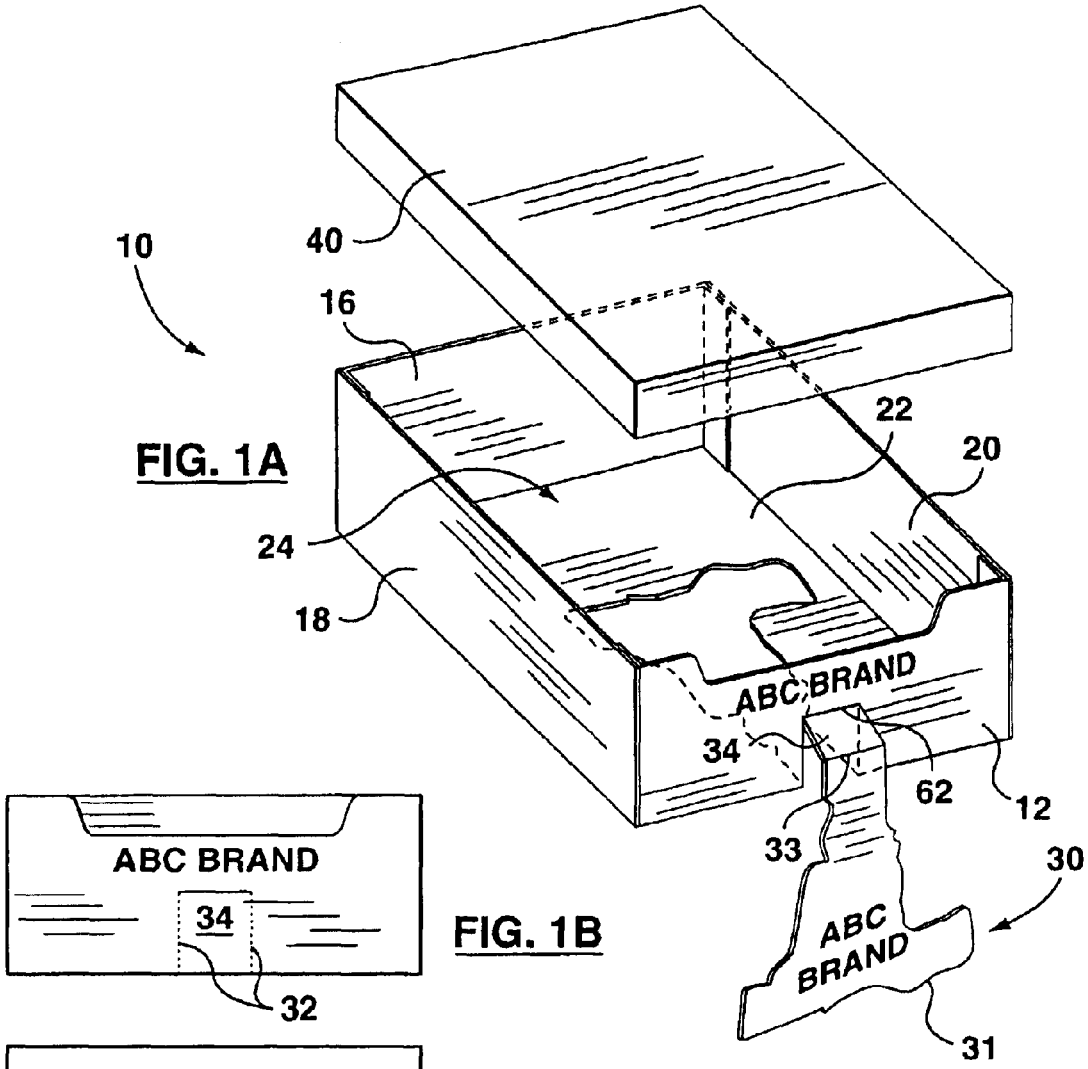
FIG. 1A
FIG. 1B
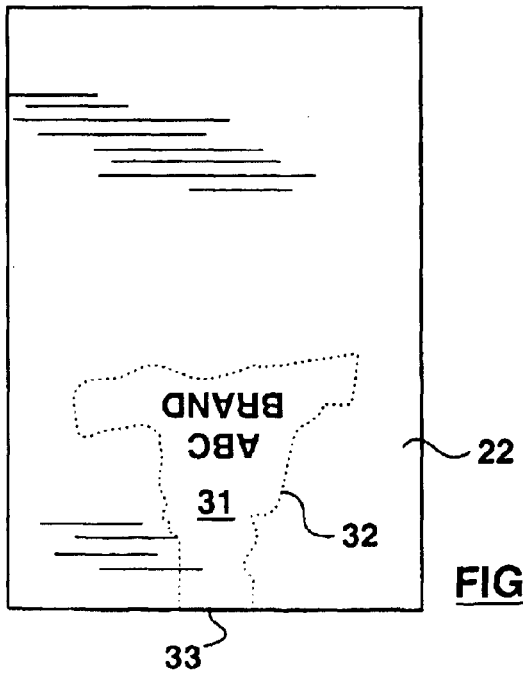
FIG. 1C
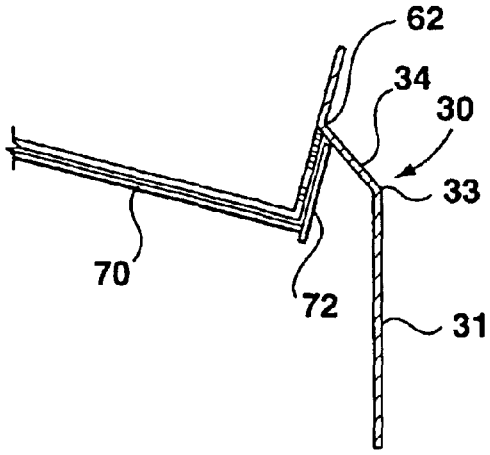
FIG. 1D

DISPLAY BOX

FIELD OF THE INVENTION

This invention relates to the field of displaying articles for sale at retail. In particular, the invention relates to boxes in which the goods may be shipped and placed directly on shelves for retail sale.

BACKGROUND OF THE INVENTION

A particularly convenient form for both manufacturers and retailers for retail goods is to arrange for the box in which the goods are shipped to the retailer to also function as the retail display box. This way the goods do not have to be unpacked from a shipping carton and then loaded into some type of display device. In order to facilitate this, many display racks for retail goods are configured to accept the manufacturer's original shipping containers.

Because the shipping carton is then used as a display box, the shipping carton is printed with trade marks, promotional markings and other devices which help in the marketing and retailing process. Principally when the shipping box is displayed on such a rack, there is usually only one panel which faces the consumer. In this disclosure and claims, that panel is referred to as a front panel. The front panel will be visible in almost all situations and will contain whatever brand names and other advertising material the manufacturer wishes to have on display in the retail setting. It may be that the top panel, side panels and possibly even the rear panel will also be available for viewing when the box is placed in the retail display rack. Accordingly, the side panels and the rear panel may also contain brand names, trade marks, trade names or other marketing indicia.

In many situations, the retail box is displayed on a shelf. The shelf may have an upturned lip to hold the box in place and the lip may obscure a portion of the front panel of the box. Also, it is often desired to have some type of additional display panel which adds more room for promotional messages beyond those which may be contained on the front panel alone. In addition, it may be desirable for particular promotional material to stand out in order to attract a consumer's attention. Advantageously, this material is all printed at the supplier. Such an additional display item is some times referred to as a "dangler". This nomenclature is used because the additional display panel typically would dangle downwardly from the display stand itself. In order to provide such a dangler, an additional separate panel usually made from laminate is printed. This separate panel is placed with the product, often by the manufacturer's sales staff. However, as the retailer's staff continue to replenish the rack, the dangler may be removed or inappropriately displayed.

Accordingly, there is need for a better system of providing additional advertising panels, which increases the likelihood that the additional advertising panels will be displayed as intended by the manufacturer and which does not require the manufacturer's staff to place the dangler on the shelf.

SUMMARY OF THE INVENTION

According to the present invention, a combination shipping/display box for displaying goods for sale is provided. The box comprises:

a front panel, a bottom panel and a plurality of other panels;

the front, bottom and other panels defining a compartment for holding the goods, at least one of the bottom panel and the front panel including a display tab integrally formed therein, the display tab having a perforated first edge and a second edge adapted to hingedly attach the display tab to the box, the display tab being adapted to movably detach from said box along said perforated first edge but remain attached to said box along the second edge.

Preferably, the display tab comprises a display portion, a swing portion hingedly attached to the box along the second edge, and a hinge means for movement of the display portion relative to the swing portion. More preferably, the hinge means is a hinge fold defined in the display tab.

BRIEF DESCRIPTION OF THE DRAWINGS

A better understanding of the invention will be gained from reference to the attached drawings which illustrate a preferred embodiment of the invention and in which:

FIG. 1A is a perspective view of a box in accordance with a preferred embodiment of the invention and showing the box in the retail display configuration;

FIG. 1B is a front view of the box of FIG. 1A in the shipping configuration;

FIG. 1C is a bottom view of the box of FIG. 1A in the shipping configuration;

FIG. 1D is a partial side view of the box of FIG. 1A on a shelf in the retail display configuration;

DETAILED DESCRIPTION OF THE INVENTION

Figure 2:
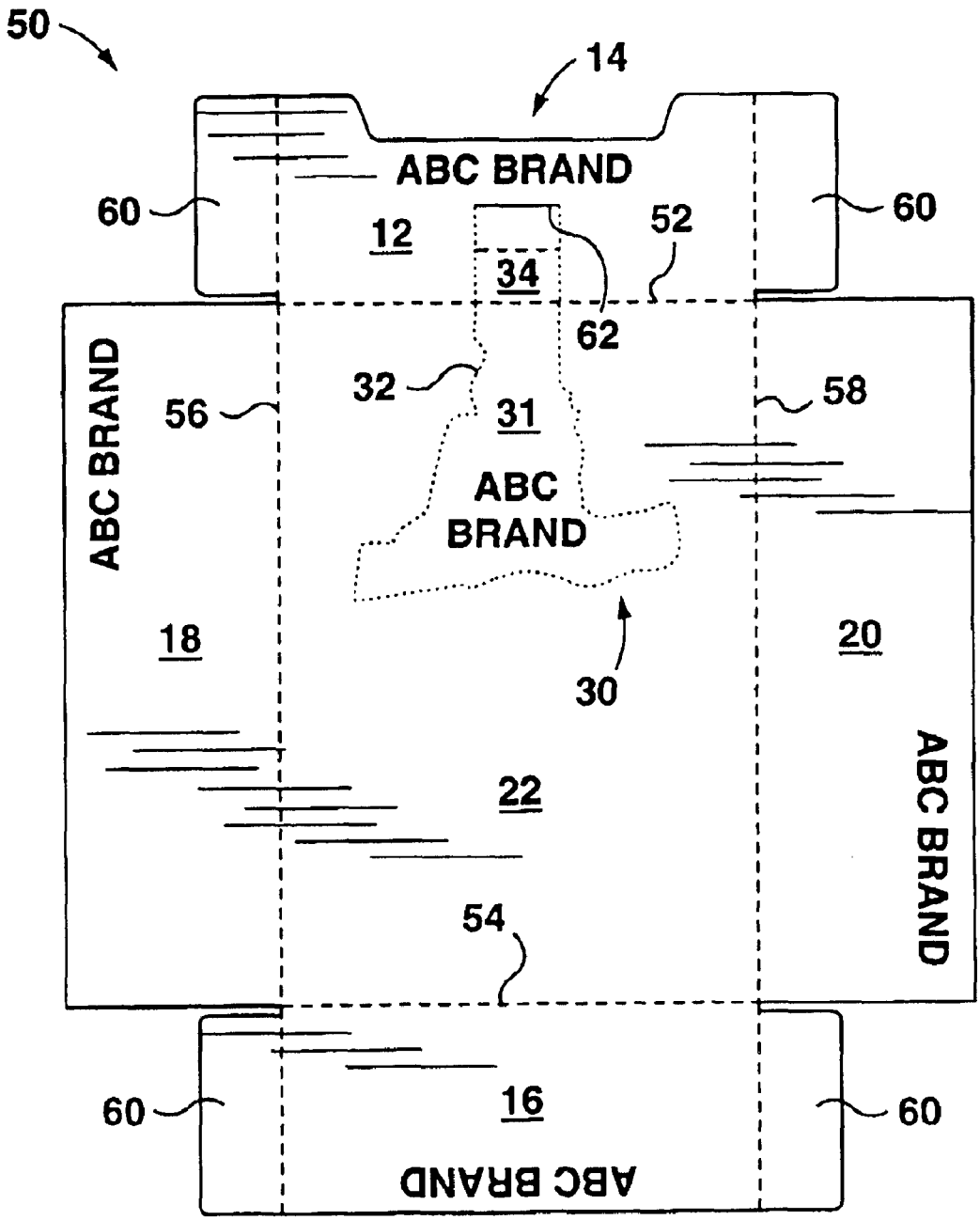
FIG. 2 is a view of a the box-making blank before folding to make the box of FIG. 1.

Other features and advantages of the present invention will become apparent from the following detailed description. It should be understood, however, that the detailed description and the specific examples while indicating preferred embodiments of the invention are given by way of illustration only, since various changes and modifications within the spirit and scope of the invention will become apparent to those skilled in the art from this detailed description.

From review of FIG. 1A, it will be noted that the box 10 comprises a front panel 12, a rear panel 16, side panels 18 and 20, and a bottom panel 22.

When the box 10 is used to ship goods for sale at retail from a supplier to a retailer, the box 10 may be fitted with a lid 40. The lid 40 may be in the form of a typical shoebox type lid, that is, with depending skirts which extend over the front, rear and side walls of the box 10. Alternatively, the top of the box 10 may be closed by a removable cover of some type of removable material such as shrinkwrap plastic or the like. Alternatively, the box 10 may be an enclosed box (not shown) having a perforated section in the top panel so that an opening for dispensing the goods can be provided by the retailer when displaying the box in the store.

The front 12, rear 16, side panels 18 and 20 and bottom panel 22 comprise a compartment 24 illustrated in FIG. 1A into which goods for retail may be loaded for shipment and retail display.

As shown in FIGS. 1A and 1D, when the box 10 is arranged for display, the box 10 includes a display tab 30, which preferably extends below the front panel 12 and provides additional space for merchandising indicia.

The blank from which the box 10 may be constructed is illustrated in FIG. 2. The blank 50 is die cut or the like, to form a plurality of panels which may be folded about fold lines to comprise the box 10. As shown in FIG. 2, the blank 50 comprises a portion which defines the bottom panel 22. The blank also has a portion which comprises the front panel 12 which is attached to the bottom panel 22 about a fold line 52. The blank 50 also includes a rear panel 16 which is attached to the bottom panel 22 about fold line 54. The blank 50 also includes the side panel 18 which is attached to the bottom panel 22 at fold line 56. Finally, the blank 50 includes the side panel 20 which is attached to the bottom panel 22 at fold line 58.

As shown, the front panel 12 and the rear panel 10 include corner tabs 60 on either side edge which are joined to the front and rear panels respectively with extensions of fold lines 56 and 58.

In order to configure the box 10 in its final form, the front, rear and side panels are folded about the fold lines and the four corner tabs 60 are folded about the fold lines. The blank 50 is shown in FIG. 2 from the printed face. The folds are made into the page away from the reader. Adhesive is applied to the corner tabs 60 so that the corner tabs can be attached to the adjacent side panels so as to comprise a five sided, open topped box. This type of blank is manufactured routinely on existing box making machinery.

As shown in FIGS. 1C and 2, the bottom panel 22 of blank 50 preferably includes the display tab 30, which is composed of a display portion 31 and a swing portion 34. This display tab 30 is defined by a first perforated edge 32 shown in FIGS. 1B, 1C and 2.

Referring now to FIGS. 1A, 1B, and 2, the display tab 30 is preferably secured to the front panel 12 along a second integral edge 62. Preferably, the swing portion 34 is defined by the perforated edge 32 where it extends into the front panel 12 and the edge 62 which extends transversely across the front panel 12 substantially parallel to fold line 52 separating the front panel 12 from the adjacent bottom panel 22.

The perforated edge 32 as shown is of no particular shape and is intended to represent a free form shape. The perforated edge 32 involves a cut through the material of the bank 50 with cut and uncut portions. During shipping, the display tab 30 remains as integrally attached to the bottom panel 22 along the perforated edge 32, as shown in FIGS. 1B and 1C.

Referring now to FIGS. 1A and 1D, when the box 10 is set up for retail display on a shelf 70 or the like, the display tab 30 may be detached from the bottom panel 22 by fracture along the perforated edge 32 on arrival at the retail display. The display tab 30 remains attached to the adjacent front panel 12 along the second edge 62. The perforated edge 32 is manufactured with sufficient strength to permit the display tab 30 to remain an integral portion of the bottom panel 22 during the initial loading of product into the box and during shipping of the box to the retail outlet. Once the box and its contents are received by the retail outlet, the stocking staff of the retail outlet push the display tab 30 downwardly from the bottom panel 22 of the box 10 so that the display tab 30 may hang freely from the front panel 12 along the second edge 62. This will create a void in bottom panel 22 but the void is arranged so the contents of the box remain within the compartment 24. The display tab 30 in this preferred embodiment includes a swing portion 34 which is included in the front panel 12. Preferably, the swing portion 34 is integrally connected to the display portion 31 along a hinge fold 33, which permits movement of the display portion 31 relative to the swing portion 34 for greater adjustability of the display tab 30. For example, the swing portion 34 permits the display portion 31 to overhang a lip 72 of the shelf 70, as shown in FIG. 1D. The swing portion 34 is defined by extensions of the perforated edge 32 which extend into the front panel 12 and the hinge fold 33.

In the preferred embodiment illustrated in FIGS. 1 and 2, the display tab 30 may be punched out of the front panel 12 and bottom panel 22 so that the only connection between the display tab 30 and the remainder of the blank 50 is the edge 62.

If the box 10 is displayed in a configuration where the front panel 12 is substantially vertical, the display tab 30 will hang directly below the fold line 52. However, if the box 10 is displayed on an angled display rack so that the consumer can more readily see the contents of the box 10, then the display tab 30 can be arranged to hang vertically below the location of the edge 62. Edge 62 will be substantially horizontal in such a display rack. This will help to increase the visibility of the display tab 30, and in particular the display portion 31. The front panel 12 may also include a serving recess 14 to help display the merchandise within compartment 24.

To illustrate the manner of display of marketing indicia, this has been simulated on the blank 50 with the identifying letters ABC BRAND. All of this marketing indicia is printed on the same face of the blank 50. The orientation of the panels is further shown by the orientation of the letters ABC BRAND on the various panels. From reference to FIG. 2 it will be noted that the printing on the display tab 30 is on the same face of the blank as all other marketing indicia and is arranged to match the orientation of the printing on the front panel. Thus, all the printing of marketing indicia is on the same side of the blank and can be done by the printing press or the like without reorienting the blank. A fully erected box for display purposes is shown in FIG. 1 where all of the marketing indicia is displayed in appropriate orientation for reading by the passing consumer. The printing can be done on the blank before or after the blank is cut from suitable sheet material. If desired both sides of the blank may be printed. The blank can be cut from cardstock sheet material of appropriate thickness to accommodate the goods to be shipped.

While in the preferred embodiment, and for illustration purposes, the same marketing indicia "ABC BRAND", has been displayed on each of the panels and on the display tab, of course there is complete freedom to the box designer to print whatever message is desired in whatever orientation is desired on each of the panels individually. Thus, the display tab 30 need not display the brand of the product, but could be used for any marketing indicia including promotional messages, endorsements, action photographs or any other literary or visual material having a desired marketing effect.

Figure 3A:
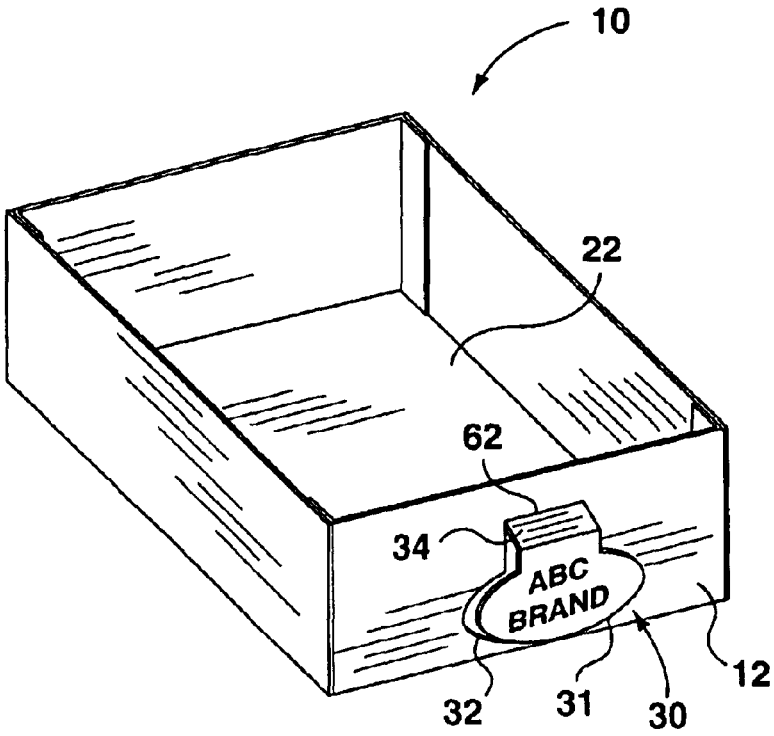
FIG. 3A is a perspective view of a box in accordance with a first alternative embodiment of the invention and showing the box in the retail display configuration.
Figure 3B:
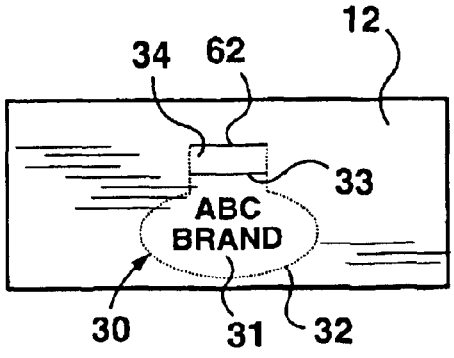
FIG. 3B is a front view of the box of FIG. 3A in the shipping configuration.
Figure 3C:
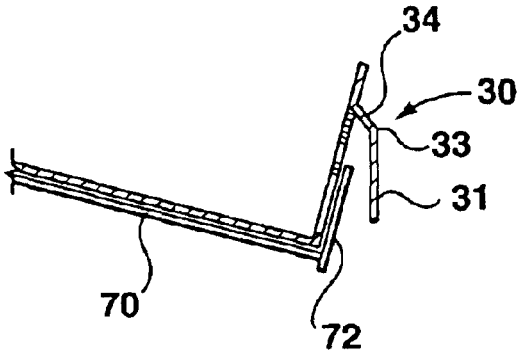
FIG. 3C is a partial side view of the box of FIG. 3A showing the box on the shelf in the retail display configuration.

FIGS. 3A–3C show a first alternative embodiment of the present invention, where the entire display tab 30 is defined within the front panel 12 of the box 10. Accordingly, when the box 10 is configured for retail, such as on the shelf 70, the display tab 30 is punched out along the perforated edge 32, but remains attached to the front panel 12 along the edge 62. The display portion 31 may be positioned relative to the swing portion 34 along hinge fold 33 provided in display tab 30. This configuration is particularly useful where the lip 72 of the shelf 70 extends upwardly to such an extent that it obscures a portion of the front panel 12 of the box 10, which would otherwise be visible. This alternative embodiment provides for a box 10 which continues to have a solid bottom panel 22 and which has the advantages (explained above) attributable to the display tab 30.

Figure 4A:
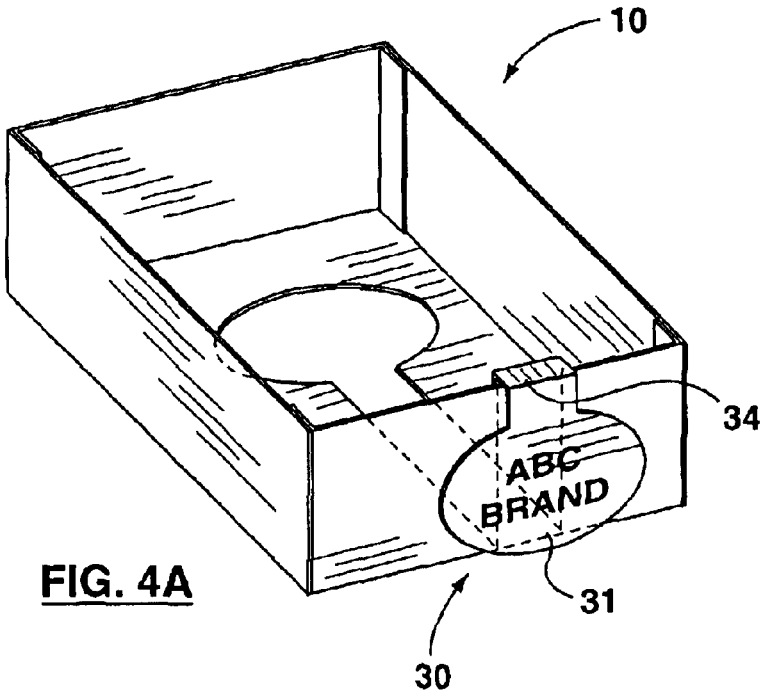
FIG. 4A is a perspective view of a box in accordance with a second alternative embodiment of the invention and showing the box in the retail display configuration.
Figure 4B:
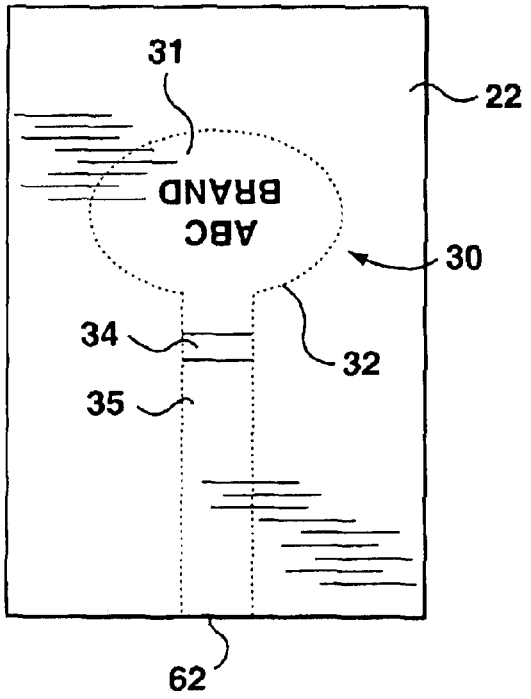
FIG. 4B is a bottom view of the box of FIG. 4A in the shipping configuration.
Figure 4C:
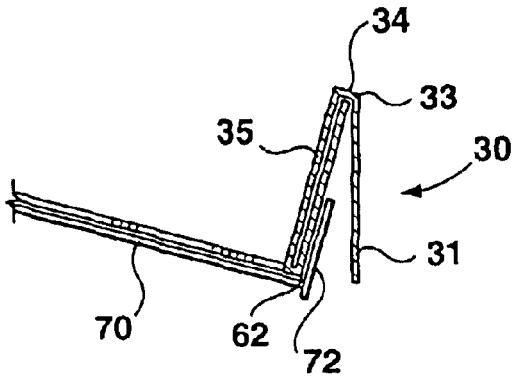
FIG. 4C is a partial side view of the box of FIG. 4A showing the box on the shelf in the retail display configuration.

FIGS. 4A–4C show a second alternative embodiment of the present invention, where the entire display tab 30 is defined within the bottom panel 22 of the box 10. In this embodiment. The display tab 30 is punched out along the perforated edge 32, but remains attached to the bottom panel 22 along the edge 62, which may coincide with fold line 52. The display tab 30 includes a display portion 31, a swing portion 34, and preferably a secondary swing portion 35.

There are two alternatives of deploying the display tab 30 for this embodiment. The display tab 30 may be punched out along the perforated edge 32 prior to the goods being loaded into the box 10. After the goods are loaded into the box 10, the swing portion 34 and the display portion 31 of the display tab 30 may then be positioned over the goods as shown by the dashed line in FIG. 4C. When the box 10 is ready for display, the swing portion 34 may be pivoted with respect to secondary swing portion 35 and the display portion 31 may be positioned relative to the swing portion 34 along hinge fold 33 provided in display tab 30. This alternative works best for a narrow display tab 30, as a void is left in the bottom panel 22 during shipping. Accordingly, the goods must be positioned in a manner which reduces the likelihood of the goods falling out of the box during shipping.

Alternatively, the box 10 may be filled with goods and shipped with the display tab 30 fully attached to the bottom panel 22 along perforated edge 32. Prior to retail display of the box, at least a portion of the goods are removed so that the display tab 30 may be punched out and deployed as shown in FIG. 4C. The goods are then replaced in the box 10.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A combination shipping/display box for displaying goods for sale, said box comprising, A front panel, a bottom panel, a plurality of side panels and a removable top, said front, bottom and side panels defining an open compartment for holding said goods upon removal of said top, at least one of said bottom panel and said front panel including a display tab integrally formed therein, said display tab having a perforated first edge separating said display tab from the remainder of said at least one of said bottom panel and said front panel and a second edge adapted to hingedly attach said display tab to said box, said display tab being adapted to movably detach from said box along said perforated first edge but remain attached to said box along said second edge, and wherein said display tab includes a swing portion and a display portion, said swing portion being hingedly attached to said box along said second edge.

2. A box according to claim 1, wherein the display tab comprises a swing portion and a display portion, said swing portion being hingedly attached to said box along said second edge.

3. A box according to claim 2, wherein said display tab further comprises a hinge means for movement of said display portion relative to said swing portion.

4. A box according to claim 3, wherein said hinge means is a hinge fold defined in said display tab.

5. A box according to claim 3, wherein said display tab is formed in said front panel.

6. A box according to claim 5, wherein said second edge comprises a fold.

7. A box according to claim 3, wherein said display tab is formed in said bottom panel.

8. A box according to claim 7, wherein said display tab further comprises a secondary swing portion positioned on an interior side of said front panel during display.

9. A box according to claim 3, wherein said swing portion is formed in said front panel and said display portion is formed in said bottom panel.

10. A box according to claim 4, wherein said swing portion is formed in said front panel and said display portion is formed in said bottom panel.

11. A box according to claim 10, wherein said hinge fold is formed by an edge between said front panel and said bottom panel.

12. A box according to claim 2, wherein said second edge comprises a fold.

13. A box according to claim 12, wherein said second edge is formed in said front panel.

14. A box according to claim 12, wherein said second edge is formed within said bottom panel.

15. A box according to claim 3, wherein said display tab has marketing indicia thereon.

16. A box according to claim 15, wherein said front panel includes marketing indicia thereon.

17. A combination shipping/display box for displaying goods for sale, said box comprising, a front panel, a bottom panel and a plurality of other panels, said front, bottom and other panels defining a compartment for holding said goods, at least one of said bottom panel and said front panel including a display tab integrally formed therein, said display tab having a perforated first edge and a second edge adapted to hingedly attach said display tab to said box, said display tab being adapted to movably detach from said box along said perforated first edge but remain attached to said box along said second edge, said display tab comprising a swing portion and a display portion, said swing portion being hingedly attached to said box along said second edge, said display tab further comprising a hinge means for movement of said display portion relative to said swing portion, and said swing portion is formed in said front panel and said display portion is formed in said bottom panel.

18. The box according to claim 17 wherein said hinge means is a hinge fold defined in said display tab.

19. A box according to claim 18 wherein said hinge fold is formed by an edge between said front panel and said bottom panel.

* * * * *